US005691704A

United States Patent [19]

Wong

[11] Patent Number: 5,691,704

[45] Date of Patent: Nov. 25, 1997

[54] PRACTICAL AND IMPROVED FIRE DETECTOR

[75] Inventor: Jacob Y. Wong, Santa Barbara, Calif.

[73] Assignee: Engelhard Sensor Technologies, Inc., Iselin, N.J.

[21] Appl. No.: 593,750

[22] Filed: Jan. 29, 1996

[51] Int. Cl.[6] ..... G08B 17/10

[52] U.S. Cl. ..... 340/628; 340/630; 340/632

[58] Field of Search ..... 340/628, 630, 340/629, 286.05, 632, 522

[56] References Cited

U.S. PATENT DOCUMENTS

| | | | |
|---|---|---|---|
| 4,186,390 | 1/1980 | Enemark | 340/630 |
| 4,688,021 | 8/1987 | Buck | 340/522 |
| 5,100,479 | 3/1992 | Wise | 136/225 |
| 5,159,315 | 10/1992 | Schultz | 340/628 |
| 5,376,924 | 12/1994 | Kubo et al. | 340/632 |
| 5,526,280 | 6/1996 | Consadori | 340/632 |

*Primary Examiner*—Jeffery Hofsass
*Assistant Examiner*—Anh La
*Attorney, Agent, or Firm*—Lyon & Lyon LLP

[57] ABSTRACT

A fire detector which combines an NDIR $CO_2$ gas detector with a photoelectric smoke detector to minimize false alarms by logic means that can be integrated into a single chip that can have an ASIC section and a microprocessor section. The NDIR $CO_2$ detector can be single or dual channel. The NDIR $CO_2$ gas detector and the photoelectric smoke detector can be separate or combined in a single device in which they are optically isolated by a light-tight barrier but still use a common light source. Also, the $CO_2$ and smoke detectors can be combined on a single substrate within a common housing.

20 Claims, 6 Drawing Sheets

PRACTICAL AND IMPROVED FIRE DETECTOR

FIELD OF THE INVENTION

The present invention is in the field of early warning devices for fire detection.

RELATED PATENT APPLICATIONS

A companion patent application by the present inventor entitled *"An Improved Fire Detector"* was fled simultaneously with the present application, the disclosure of which is specifically incorporated herein by referrence. The companion application, using carbon dioxide gas generation rates data collected in fire tests performed in accordance with ANSI/UL 217-1985, Mar. 22, 1985, shows that a combination of a smoke detector and a carbon dioxide ("$CO_2$") gas detector, used as a fire detector, can significantly reduce maximum response time and detect common types of fires, including slow moving smoldering and almost smoke free fast moving fires, while still minimizing false alarms.

BACKGROUND OF THE INVENTION

Since 1975, the U.S. experienced remarkable growth in the usage of home smoke detectors, principally single-station, battery-operated, ionization-mode smoke detectors. This rapid growth, coupled with clear evidence in actual fires and fire statistics of the lifesaving effectiveness of detectors, made the home smoke detector the fire safety success story of the past two decades.

In recent years, however, studies of the operational status of smoke detectors in homes revealed an alarming statistic that as many as one-fourth to one-third of smoke detectors are non-operational at any one time. Over half of the non-operational smoke detectors are attributable to missing batteries. The rest is due to dead batteries and non-working smoke detectors. The principal cause of missing batteries was traceable to the frustration of homeowners over nuisance alarms, which are detector activations caused not by hostile, unwanted fires but by controlled fires, such as cooking flames. These nuisance or false alarms are also caused by non-fire sources, such as the condensation of moisture carried out of a bathroom after someone has taken a shower, blowing dust or debris during cleaning in living quarters or oil vapors escaping from the kitchen.

The reason why the majority of smoke detectors, which are of the ionization type, is prone to these types of nuisance alarms is that they are very sensitive to both visible and invisible diffused particulate matter, especially when the fire alarm threshold is set very low in order to meet the mandated response time for ANSI/UL 217 certification for various types of fires. The size of visible particulate matter ranges from 4 to 5 microns in size, (although small particles can be seen as a haze when present in high mass density,) and they are generated copiously in most open fires or flames. However, ionization detectors are most sensitive to invisible particles ranging from 1.0 to 0.01 microns in size. Most household non-fire sources, as discussed briefly above, generate mostly invisible particulate matters. This explains why most home smoke detectors encounter so many nuisance alarms.

The problem of frequent false alarms, caused by ionization smoke detectors resulting in a significant portion of them at any one time functionally non-operational, led to the increased usage in recent years of another type of smoke detector, namely the photoelectric smoke detector. Photoelectric smoke detectors work best for visible particulate matter, and are relatively insensitive to invisible, particulate matter. They are therefore less prone to nuisance alarms. However, the drawback is that they are very slow responding to smoldering fires where the early particulate matter generated is mostly invisible. In order to overcome this drawback, the fire alarm threshold of photoelectric smoke detectors has to be set very low or sensitive in order to meet the ANSI/US 217 certification requirements. Such low fire alarm thresholds for the photoelectric smoke detectors also lead to frequent false alarms. Thus the problem of nuisance false alarms for smoke detectors comes around in a complete circle. It is apparent that over the years the problem has been long recognized, but yet it has not been solved. It is equally apparent that a new type of fire detector is urgently needed in order to resolve this dangerous ineffectiveness of present day smoke detectors.

Another aspect of the present-day smoke detectors that is often discussed but seldom addressed is the fire response slowness of these detectors. The current ANSI/UL 217 fire detector certification code was pretty much developed and dictated years ago by the state of the fire detection technology, viz, that of the smoke detectors. Opinion of workers in the fire fighting and prevention industry over the past two decades has always been critical of the speed of response of the available smoke detectors. Obviously increasing their sensitivity through the lowering of the light obscuration detection threshold of the smoke detectors will certainly speed up their response. However, that also drives up the nuisance alarm rates. Looking from this angle, it is apparent also that a better fire detector is urgently needed.

Taking advantage of the copious production of $CO_2$ gas by virtually all manners of fires, a new type of fire detector keying on the detection of $CO_2$ gas was disclosed by the present inventor in U.S. Pat. No. 5,053,754. This new fire detector responds more rapidly to fires than the widely used smoke detectors. It senses increases in the concentration of $CO_2$ associated with a fire. The build-up of $CO_2$ is sensed by measuring the concomitant increase in the absorption of a beam of radiation whose wavelength is located at a strong absorption band of $CO_2$. The disclosed device is considerably simplified by the use of a window to the sample chamber that is highly permeable to $CO_2$ but which keeps out particles of dust, smoke, oil and water.

In subsequent U.S. Pat. Nos. 5,079,422, 5,103,096 and 5,369,397 the present inventor continued to disclose a number of improved implementation and methods of using single or multiple $CO_2$ detectors to detect fires. The superiority of using $CO_2$ detectors as fire detectors over smoke detectors in terms of speed of response and immunity against common nuisance alarms had been well established. In an earlier patent application entitled *"False Alarm Resistant Fire Detector With Improved Performance"* still pending (Ser. No. 08/077,488) and the first companion patent application entitled *"An Improved Fire Detector"*, the present inventor further disclosed the advantage of combining a $CO_2$ detector with a smoke detector to form a fast and false alarm resistant fire detector.

Even though advantages of using $CO_2$ detectors as fire detectors has been proposed, the reality is that until such time that the manufacturing cost of an NDIR $CO_2$ detector is reduced to an economically attractive level, the consumer is unwilling to purchase this new and improved fire detector because of hard nosed economics. The concomitant effort to simplify and cost reduce an NDIR $CO_2$ detector is therefore equally important and relevant in forging the advent of the currently disclosed practical and improved fire detector.

In U.S. Pat. No. 5,026,992, the present inventor began a series of disclosures on the novel simplification of an NDIR gas detector with the ultimate goal of cost reducing this device to the point that it can be used to detect $CO_2$ gas in its application as a new fire detector as discussed above. In U.S. Pat. No. 5,026,992 a spectral ratioing technique for NDIR gas analysis using a differential temperature source was disclosed that leads to an extremely simple NDIR gas detector comprising only one infrared source and one infrared detector. In U.S. Pat. No. 5,163,332, the present inventor disclosed the use of a diffusion-type gas sample chamber in the construction of an NDIR gas detector that eliminated virtually all the delicate and expensive optical and mechanical components of a conventional NDIR gas detector. In U.S. Pat. No. 5,341,214, the present inventor expanded the novel idea of a diffusion-type sample chamber of U.S. Pat. No. 5,163,332 to include the conventional spectral ratioing technique in NDIR gas analysis. In U.S. Pat. No. 5,340,986, the present inventor extended the disclosure of a diffusion-type gas chamber in U.S. Pat. No. 5,163,332 to a "re-entrant" configuration thus simplifying even further the construct of an NDIR gas detector. Still, further simplification is required if $CO_2$ sensors are to gain acceptance in low cost household fire detectors and thus fulfill the long felt need for an improved fire detector with a lower response time which still minimizes false alarms.

The present invention discloses a number of the simplest possible embodiments of a combined NDIR $CO_2$ gas detector with a conventional smoke detector to achieve a practical and improved fire detector which is affordably low in cost, yet faster than presently available smoke detectors while still minimizing false alarms.

SUMMARY OF THE INVENTION

The present invention is generally directed to a practical and improved fire detector having a fast response time that detects common fires, including smoldering and fast-moving types, while still minimizing false alarms through the combination of a smoke detector and a $CO_2$ detector. In particular, the present invention has to do with the utility of novel design configurations (both mechanical and electrical) for implementing the combination of a smoke detector and an NDIR $CO_2$ gas detector as a low-cost, practical and improved fire detector.

In a first, separate aspect of the present invention, a smoke detector is used to detect smoldering fires when light obscuration exceeds a threshold level for longer than a first preselected response time or when light obscuration exceeds a reduced threshold level for longer than a second preselected time. If either of these conditions occurs, an alarm signal is generated in response to a smoldering fire. In addition, a $CO_2$ detector is used to rapidly detect fires by monitoring the rate of increase in the concentration of $CO_2$. When the rate of increase in the concentration of $CO_2$ exceeds a second predetermined rate, an alarm signal is generated.

In another, separate aspect of the present invention, the maximum response time of the fire detector is lowered by relying upon the decreased maximum response time of the $CO_2$ detector. False alarms attributable to the smoke detector are minimized since there is no significant $CO_2$ production in non-fire sources. Finally, false alarms attributable to the $CO_2$ detector are minimized by alarm logic which responds to the detecting output of both the smoke detector and the $CO_2$ detector.

Accordingly, it is a primary object of the present invention to provide a low-cost, practical and improved fire detector with a reduced maximum response time which still minimizes false alarms.

This and further objects and advantages will be apparent to those skilled in the art in connection with the drawings and the detailed description of the preferred embodiment set forth below.

DETAILED DESCRIPTION OF THE PREFERRED EMBODIMENT

Figure 1:
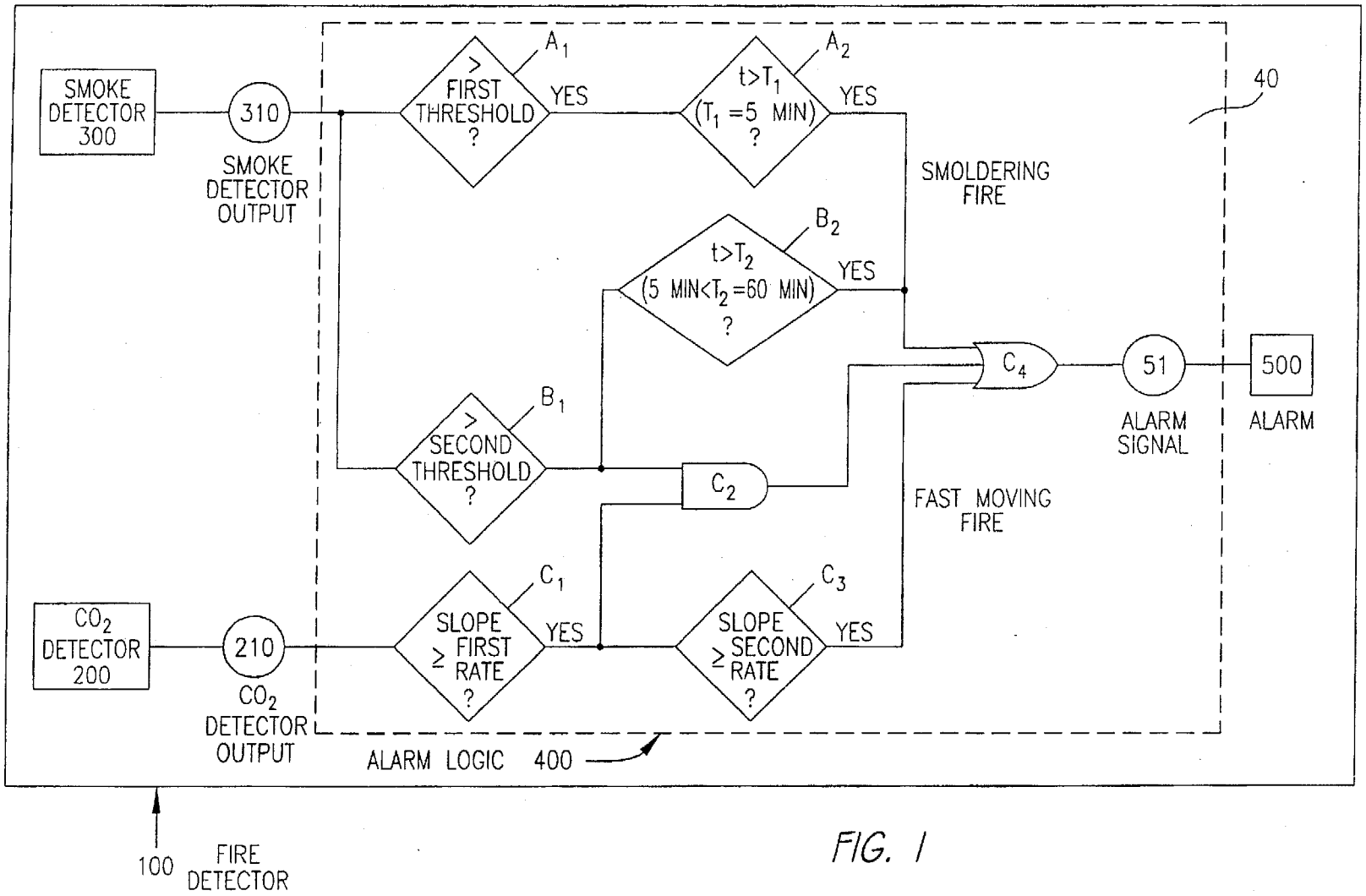
FIG. 1 is a logic diagram for a signal processor used in the preferred embodiment of the present invention.

FIG. 1 is a logic diagram for a signal processor used in the preferred embodiment of a practical and improved fire detector. This logic diagram is also used in the companion patent application entitled "*An Improved Fire Detector*" authored by the present inventor.

Figure 2:
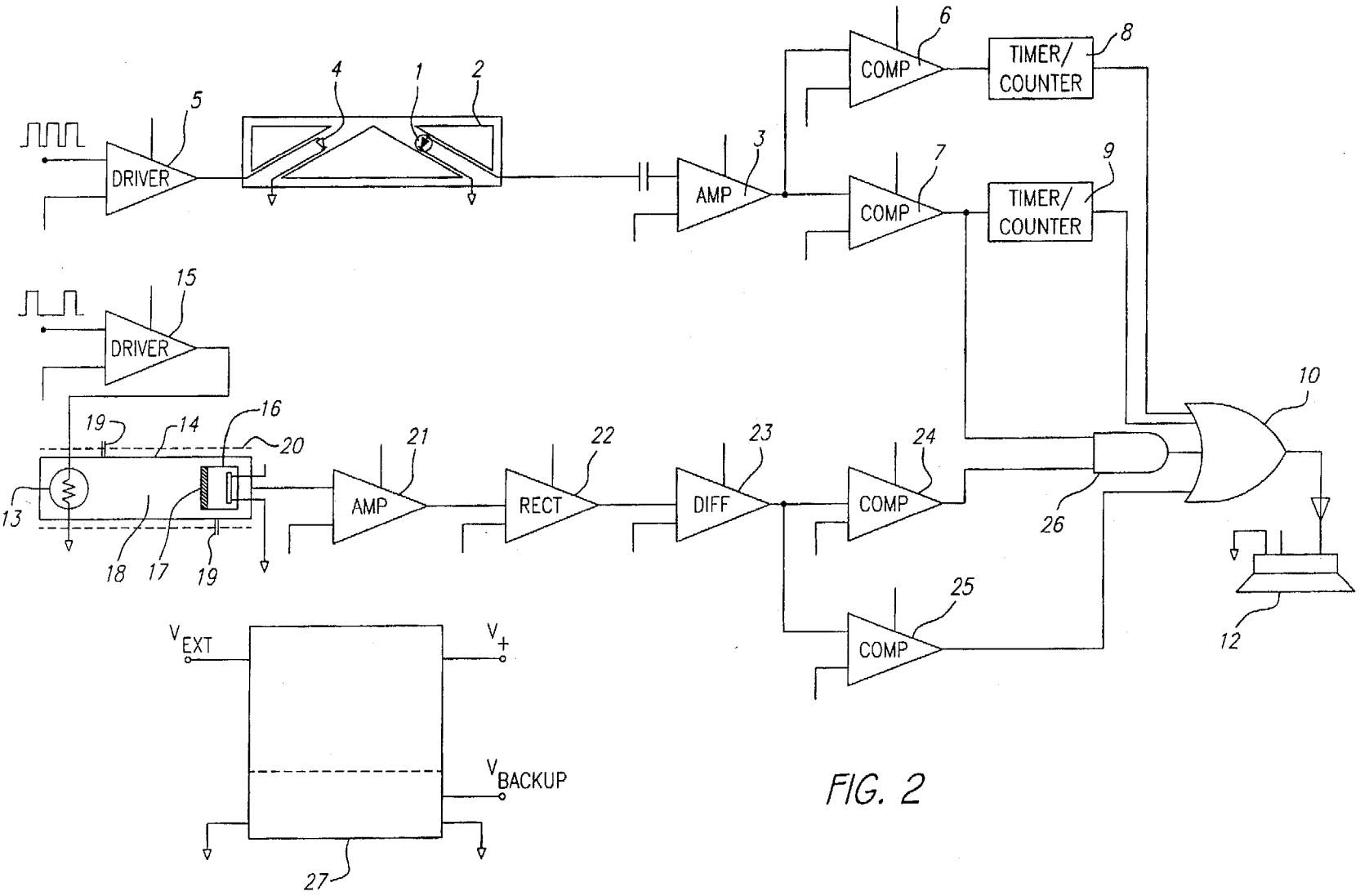
FIG. 2 is a schematic layout of a preferred embodiment of the current invention for a practical and improved fire detector showing a combination of a photoelectric smoke detector and an NDIR $CO_2$ gas detector and their respective signal processing circuit elements and functional relationships.

In the preferred embodiment shown in FIG. 2, the pulsed output of the silicon photodiode 1 of the photoelectric smoke detector 2 is AC coupled to a sample and hold integrator 3. The LED 4 of the photoelectric smoke detector 2 is pulsed by driver 5 at a frequency of typically 300 Hz and a duty factor typically of 5%. Under normal operating condition, i.e. in the absence of a fire, the AC output of photodiode 1 is near zero as no light is scattered into it from the LED source 4. During a fire condition where smoke is present in the space between the LED 4 and the photodiode 1, an AC output signal whose magnitude depends upon the smoke density, appears at the input of sample and hold integrator 3.

The output of the sample and hold integrator 3, which is a DC signal, is fed into a high and low threshold comparator 6 and 7, respectively. The reference voltage at the high obscuration threshold comparator 6 represents a signal strength of scattered light at the silicon photodiode where the obscuration due to the smoke condition is approximately 7%. Thus when the smoke obscuration is equal to or exceeds 7% at the photoelectric smoke detector 2, the output of comparator 6 will be at a HIGH logic gate. Similarly, reference voltage at the low obscuration comparator 7 represents a signal strength of scattered light at the silicon photodiode where the obscuration due to the smoke condition is less than 7%, e.g. 2%. Thus, when the smoke obscuration is equal to or exceeds 2% at the photoelectric smoke detector 2, the output of comparator 7 will be at HIGH logic state.

The outputs of comparators 6 and 7 are connected, respectively, to timers 8 and 9. Timer 8 is set approximately at 5 minutes and timer 9 is set approximately at 15 minutes. The timers 8 and 9 will be activated only when the output logic states of comparators 6 and 7 are HIGH respectively. The outputs of timers 8 and 9 form two of the four inputs to the "OR" gate 10. The output of the "OR" gate 10 is buffered by amplifier 11 before connected to the input of the siren alarm 12. The siren alarm 12 will sound any time when the output of the "OR" gate is TRUE or HIGH.

The output of low obscuration comparator 7 also forms one of the two inputs to the "AND" logic gate 26. The output of the "AND" gate 26 forms the third input to the "OR" gate 10.

The infrared source 13 of the NDIR $CO_2$ gas detector 14 is pulsed by current driver 15 at the rate of typically 1 Hz. The pulsed infrared light incidents on infrared detector 16 through a thin film narrow bandpass interference 17 that allows only 4.26 microns radiation through to the detector. The filter 17 has a center wavelength at 4.26 microns with a full width at half maximum (FWHM) pass band of approximately 0.2 microns. $CO_2$ gas has a very strong infrared absorption band located spectrally at 4.26 microns. The amount of 4.26 microns radiation reaching the infrared detector 16 would depend upon the concentration of $CO_2$ gas present between the source 13 and the detector 16.

The infrared detector 16 is a single-channel micron-machined silicon thermopile with an optional built-in temperature sensor in intimate thermal contact with the reference junction. The sample chamber body 18 of the NDIR $CO_2$ detector has small openings on opposite sides that enable ambient air to diffuse naturally through the sample chamber area between the source 13 and the detector 16. These small openings are covered with a special fiberglass supported silicon membrane 20 to only let $CO_2$ through but prevent dust and moisture-laden particulate matter from entering the sample chamber area 18.

The output of the thermopile detector 16, which is a modulated signal, is first amplified by preamplifier 21 and then rectified to a DC voltage by rectifier 22 before being differentiated by differentiator 23. The output of differentiator 23, which is proportional to the rate of change of $CO_2$ concentration in the sample chamber 18, is fed into a pair of comparators 24 and 25. Comparator 24 is a low rate of rise comparator and its reference voltage corresponds to a rate of change of $CO_2$ concentration of approximately 200 ppm/min. When this rate of change for $CO_2$ is detected or exceeded, the output of the low rate of rise comparator 24, which is connected to the second input to the "AND" gate 26, will go "HIGH" or "TRUE".

Comparator 25 is the high rate of rise comparator and its reference voltage corresponds to a rate of change of $CO_2$ concentration of approximately 1,000 ppm/min. When this rate of change for $CO_2$ is detected or exceeded, the output of the high rate of rise comparator 25, which forms the fourth input to the "OR" gate 10, will go "HIGH" or "TRUE".

The power supply module 27 takes an external supply voltage $V_{ext}$ and generates a voltage $V_+$ for powering all the circuitry mentioned earlier. A back-up power supply using standard batteries can also be derived from module 27 in a straight forward manner.

The logic for the signal processor for the present invention of a practical and improved fire detector as shown in FIG. 1 is implemented by the schematic layout of the preferred embodiment as shown in FIG. 2 and the accompanying description above.

Figure 3:
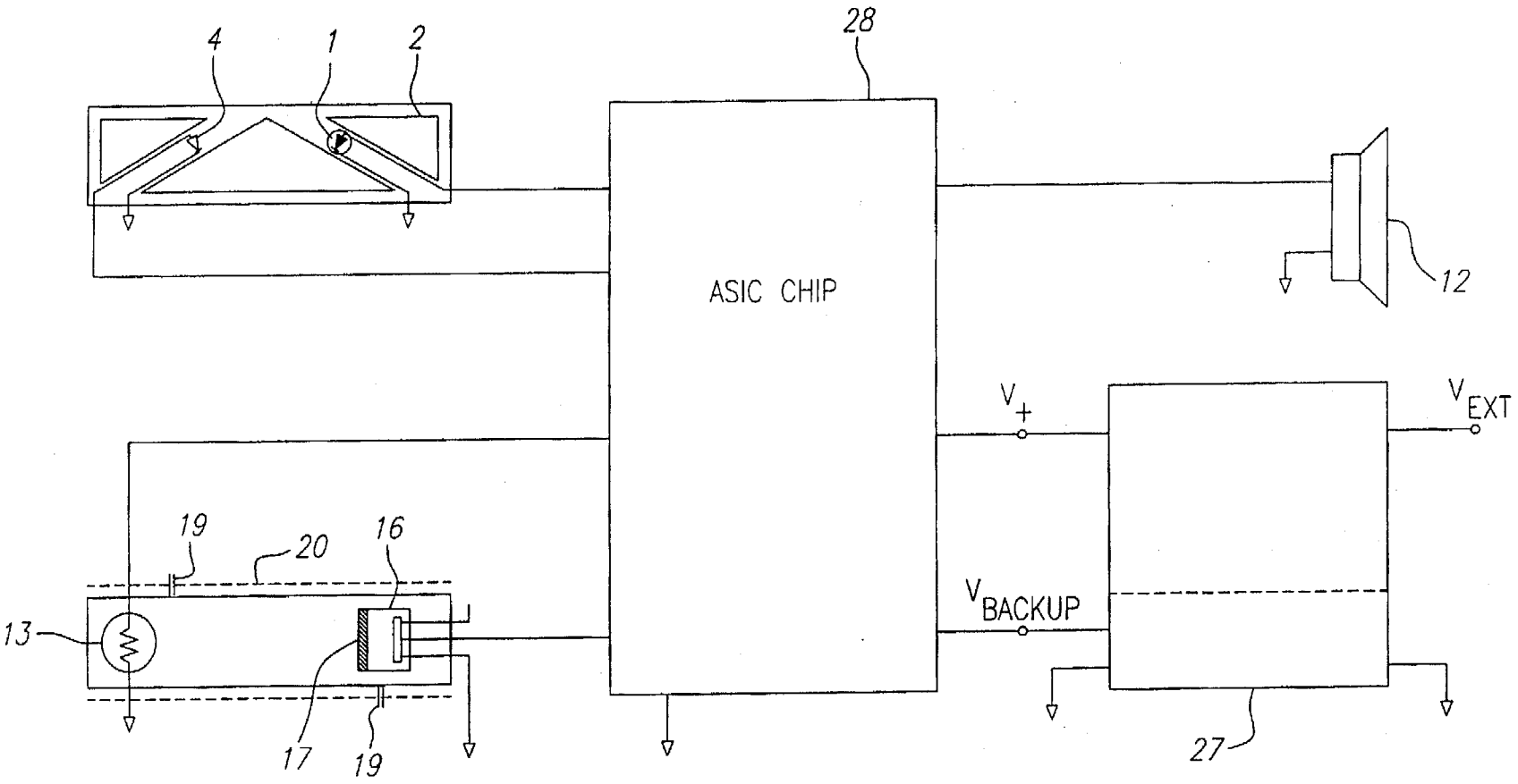
FIG. 3 is a schematic layout of a first alternate preferred embodiment of the current invention for a practical and improved fire detector.

In the first alternate preferred embodiment shown in FIG. 3, all the circuit elements described and shown in FIG. 2, with the exception of the power supply module 27 and the siren alarm 12, are integrated using standard application specific integrated circuit (ASIC) technique into a single ASIC chip 28. All the functions for this first alternate preferred embodiment are exactly the same as the preferred embodiment as shown and described in FIG. 2.

Figure 4:
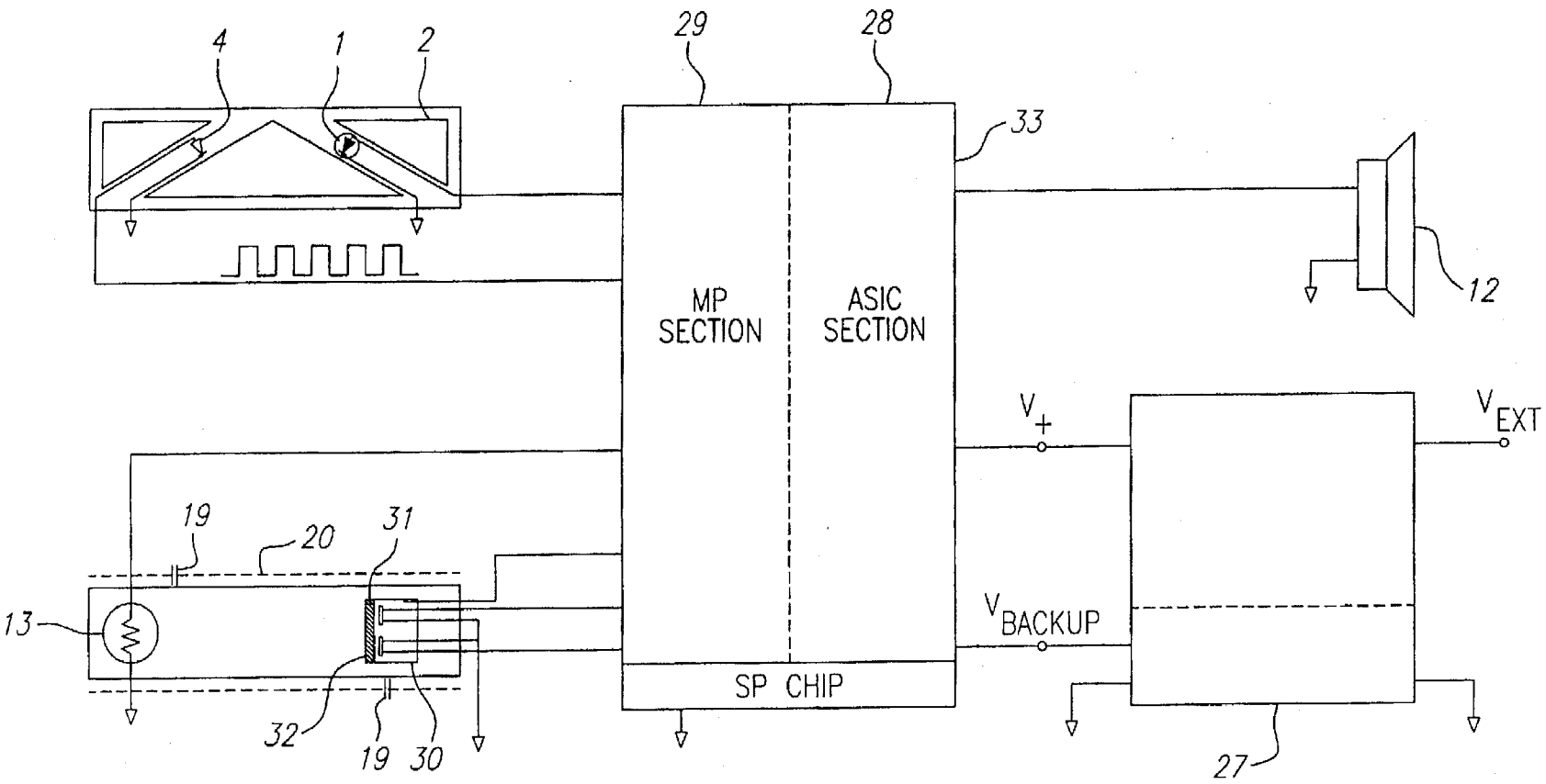
FIG. 4 is a schematic layout of a second alternate preferred embodiment of the current invention for a practical and improved fire detector.

In the second alternate preferred embodiment shown in FIG. 4, the single channel silicon micron-machined thermopile infrared detector 16 (see FIG. 2) is replaced by a dual-channel silicon micro-machined thermopile detector 30. As implemented, the $CO_2$ gas detector in this second alternate preferred embodiment is a full-fledged double-beam or dual channel NDIR gas detector. Filter 31 is thin fill narrow bandpass interference filter having a center wavelength at 4.26 microns and a FWHM of 0.2 microns. Filter 32 has a center wavelength at 3.91 microns and a FWHM of 0.2 microns. It establishes a neutral reference channel for the gas detector as there are no appreciable absorption by common gases in the atmosphere in this particular neutral pass band.

In addition to the ASIC chip 28 in this second preferred embodiment, a microprocessor section 29 is added to the overall signal processor (SP) chip 33. With the use of a dual channel $CO_2$ sensor the gas concentration is first determined by measuring the ratio between the outputs of the two detector channels within the dual-channel detector 30. The calculation of the ratio and the subsequent determination of the rate of change for $CO_2$ are performed in the microprocessor section 29 of the SP chip 33. Just like in the first alternate preferred embodiment shown in FIG. 3, all the logical functions are performed by the ASIC section 28 as before.

Figure 5:
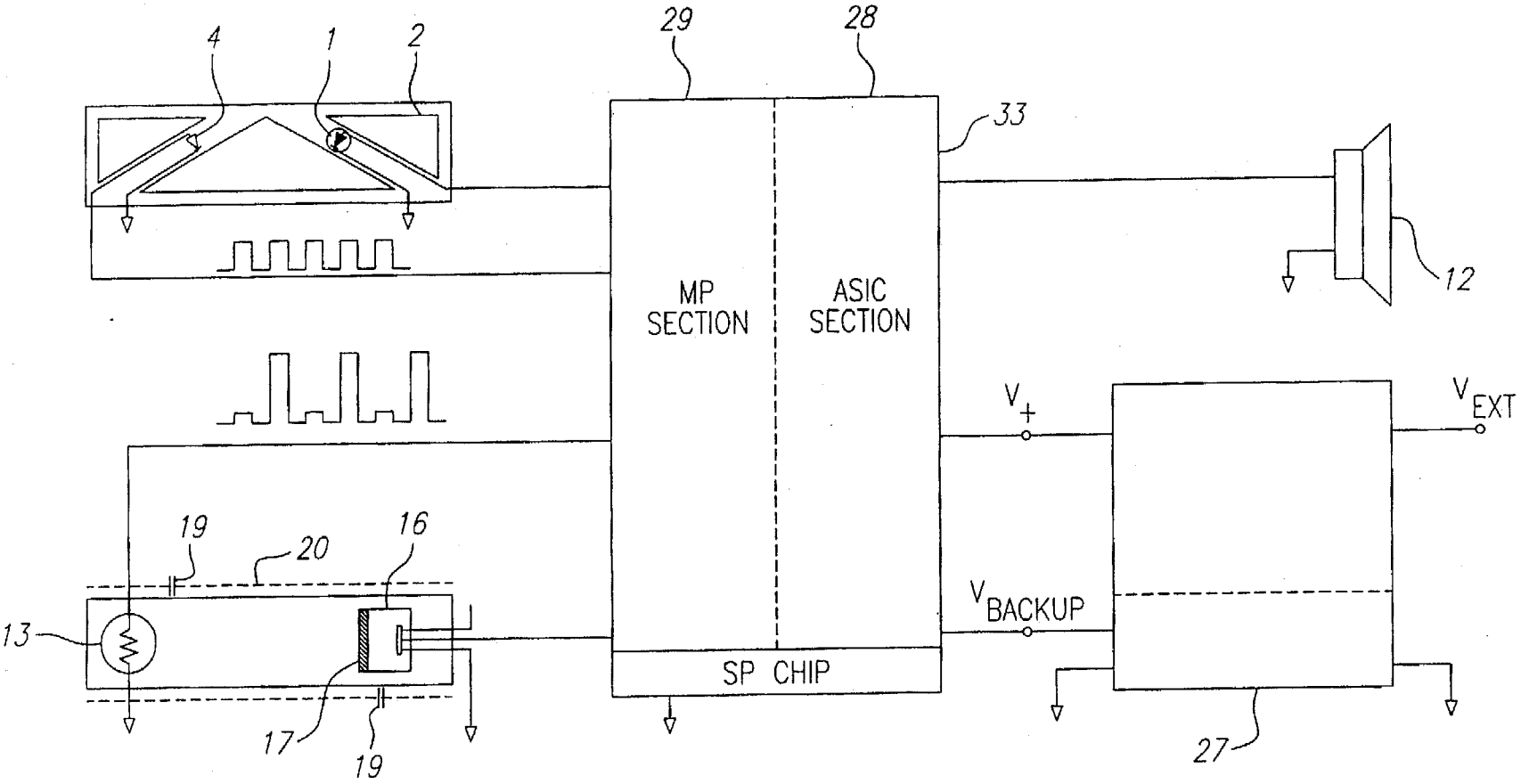
FIG. 5 is a schematic layout of a third alternate preferred embodiment of the current invention for a practical and improved fire detector.

In the third alternate preferred embodiment shown schematically in FIG. 5, the $CO_2$ gas detector is implemented with a special gas analysis technique known as "differential source" as disclosed in U.S. Pat. No. 5,026,992 by the present inventor, the disclosure of which is specifically incorporated herein by reference. In this embodiment, the SP chip 33 comprising both microprocessor section 29 and the ASIC section 28 used in the second alternate preferred embodiment (see FIG. 4) is retained. The microprocessor section generates the necessary pulsing wave forms, namely alternately two power levels, to drive the infrared source 13. Meanwhile the infrared detector needs to be only a single-channel silicon micro-machined thermopile 16 with a dual pass band filter that has two non-overlapping pass bands. One band is at 4.26 microns ($CO_2$) and the other at 3.91 microns (neutral). The rest of this embodiment is the same as the previous ones already described.

Figure 6:
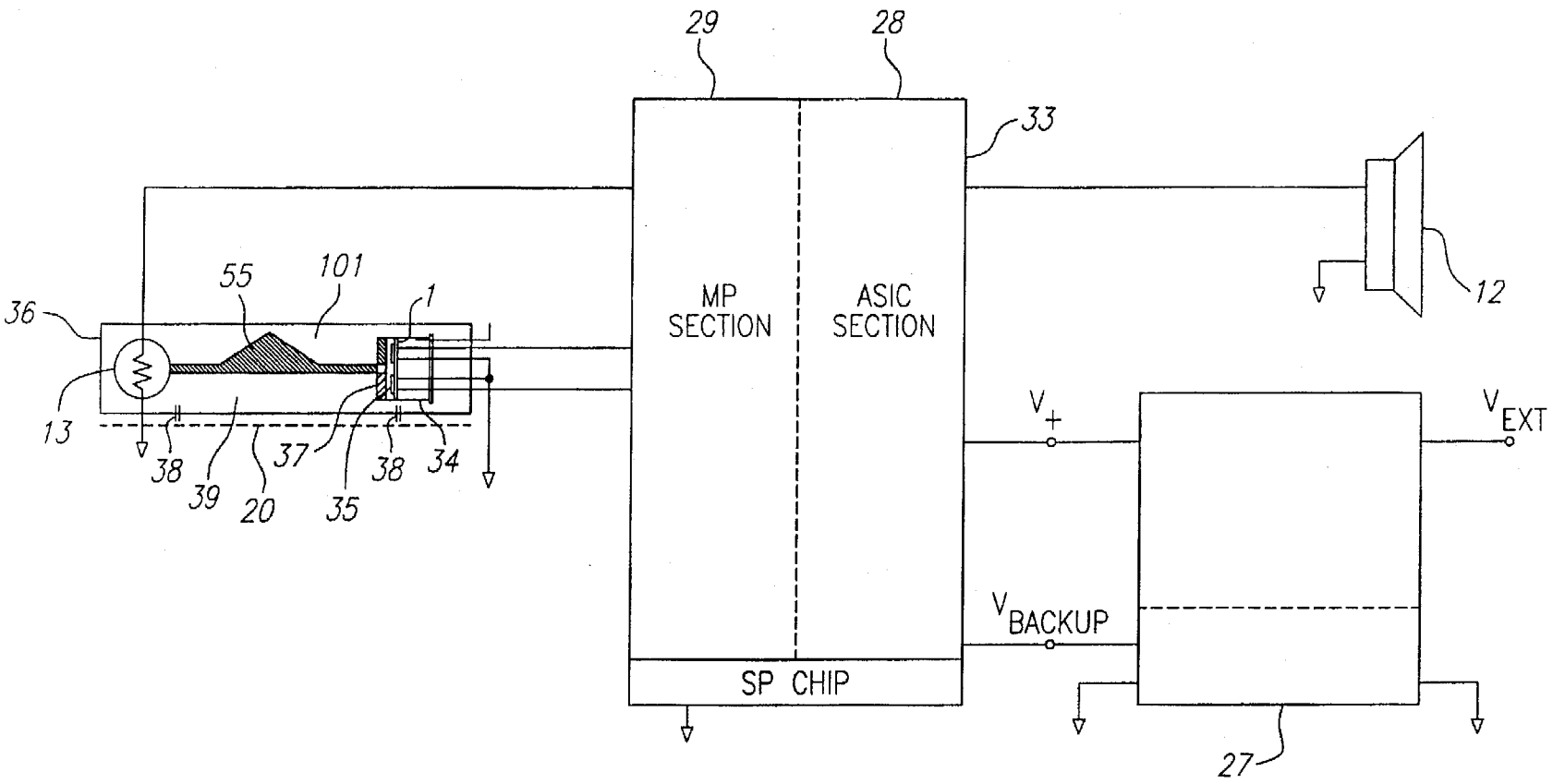
FIG. 6 is a schematic layout of a fourth alternate preferred embodiment of the current invention for a practical and improved fire detector.

In the fourth alternate preferred embodiment of the present invention as shown schematically in FIG. 6, the photoelectric smoke detector 2 and the NDIR $CO_2$ detector 14 of the previous four embodiments (see FIG. 2) are combined into a single device or detector assembly contained within a case 36. Detector 34 housed within housing 36 could be a special dual-channel detector; one channel is a thermopile detector 35 with $CO_2$ filter 37 and the other is a silicon photodiode 1 fabricated in the vicinity of it on the same substrate but optically isolated from one another. Alternatively, device 36 could consist of a single channel thermopile 35 with a $CO_2$ filter 37 and a separately packaged silicon photodiode 1.

In device 36, there is physical light-fight barrier 55 separating the two detector channels. On the $CO_2$ detector side, two or more small openings 38 are made on one side of the container wall opposite to the barrier 55 that allow ambient air to freely diffuse into and out of the sample chamber area 39 of the $CO_2$ detector. Furthermore, these small openings are covered with a special fiberglass reinforced silicon membrane 20 for screening out any dust or moisture laden particulate matters from area 39. $CO_2$ and other gases can diffuse freely across this membrane 20 without hindrance.

On the photoelectric smoke detector side 101, the light-fight barrier 55 sets up a scattering mode of operation for the light source 13 and the silicon photodiode 1 to detect smoke-caused obscuration due to fire. The microprocessor section 29 of the signal processor chip 33 processes the signals in very much the same manner as in the preferred embodiments shown and described in FIG. 2. The rest of the signal processing for this fifth alternate preferred embodiment is exactly the same as that for the previously disclosed embodiments.

As those skilled in the art will readily recognize, there are a number of ways to manufacture or configure a single channel infrared detector 16, a dual channel infrared detector 30, and the dual channel detector 34, which is comprised of a thermopile detector channel 35 and a photodiode detector 1. With respect to detectors 16 and 30, however, preferably the detector and corresponding bandpass filter(s)—depending on whether the detector is a single or dual channel infrared detector—are combined in a single platform such as a TO-5 can to form an infrared detector assembly.

The preferred construction of an infrared detector assembly employing a thermopile/bandpass filter combination to define each of the channels of the detector assembly is described in connection with FIGS. 9–16 of the U.S. patent application entitled "*Passive Infrared Analysis Gas Sensors and Applicable Multichannel Detector Assemblies*", filed Jan. 10, 1996 by Jacob Y. Wong, and having an attorney docket number of 212/231, the description of which is hereby incorporated by reference as if fully set forth herein. The specific detector assembly embodiment described in connection with FIGS. 9–16 of the 212/231 application is a three channel detector assembly. Thus, each of the three channels in the disclosed infrared detector assembly is comprised of a thermopile detector and an appropriate corresponding bandpass filter. The referenced detector assembly of the 212/231 application can be modified, however, for use in the present invention merely by selecting the appropriate number of thermopile/filter combinations—namely, one or two—to thereby define the appropriate number of channels for the desired application. For example, the embodiments described in connection with FIGS. 2, 3 and 5 of the present application would only require a single channel detector assembly, whereas the embodiment described in connection with FIG. 4 would employ a two channel detector assembly. As one skilled in the art would readily recognize, therefore, the same principles of construction employed and advantages obtained with respect to the three channel detector assembly described in connection with FIGS. 9–16 of the 212/231 application are equally applicable to the single and dual channel infrared detector/filter combinations disclosed in connection with the various preferred embodiments of the present application.

Similarly, in connection with dual channel detector 34 described in connection with FIG. 6, the same principles of construction are equally applicable to the micromachined thermopile detector 35/$CO_2$ filter 37 combination. Further, as one skilled in the art would readily recognize, it is possible to fabricate silicon photodiode 1 on the same silicon substrate as thermopile 35.

It will be readily apparent to those skilled in the art that still further changes and modification in the actual concepts described herein can readily be made without departing from the spirit and scope of the invention as defined by the following claims.

What is claimed is:

1. A fire detector, comprising:

a smoke detector;

a non-dispersive infrared (NDIR) carbon dioxide ($CO_2$) sensor;

logic means for generating an alarm signal when any of the following criteria are met:

light obscuration exceeds a threshold level for greater than a first preselected time;

light obscuration exceeds a reduced threshold level for greater than a second preselected time; or light obscuration exceeds the reduced threshold level and the rate of increase in the concentration of $CO_2$ exceeds a predetermined rate; and an alarm responsive to the alarm signal.

2. A fire detector as recited in claim 1, wherein the smoke detector is a photoelectric smoke detector.

3. A fire detector as recited in claim 2, wherein the photoelectric smoke detector uses a silicon photodiode.

4. A fire detector as recited in claim 2, wherein the NDIR $CO_2$ sensor uses a single-channel micro-machined silicon thermopile as an infrared detector.

5. A fire detector as recited in claim 4, wherein the logic means relies on the rate of change in $CO_2$ concentration to detect the rate of increase in the concentration of $CO_2$.

6. A fire detector as recited in claim 5, wherein the logic means is integrated into an application specific integrated circuit (ASIC) chip.

7. A fire detector as recited in claim 4, wherein the NDIR $CO_2$ sensor uses a thin film narrow bandpass interference filter having a center wavelength at 4.26 microns and a full width at half maximum (FWHM) of 0.2 microns.

8. A fire detector as recited in claim 2, wherein the NDIR $CO_2$ sensor uses a dual-channel silicon micron-machined thermopile detector with a built-in temperature sensor in intimate thermal contact with a reference junction of the thermopile as an infrared detector.

9. A fire detector as recited in claim 8, wherein the logic means measure a ratio between outputs of the two detector channels of the thermopile detector to calculate $CO_2$ concentration.

10. A fire detector as recited in claim 9, wherein the logic means is integrated into a signal process chip.

11. A fire detector as recited in claim 10, wherein the signal processor chip uses a microprocessor section to calculate the ratio and determine the rate of change for $CO_2$.

12. A fire detector as recited in claim 8, wherein the NDIR $CO_2$ sensor uses a thin film narrow bandpass interference filter having a center wavelength at 4.26 microns and a FWHM of 0.2 microns for a first channel and a neutral filter centered at 3.91 microns and a FWHM of 0.2 microns for a second channel.

13. A fire detector as recited in claim 2, wherein the NDIR $CO_2$ sensor uses a differential source gas analysis technique.

14. A fire detector as recited in claim 13, wherein the logic means is integrated into a signal processing chip that includes an ASIC section and a microprocessor section.

15. A fire detector as recited in claim 14, wherein the microprocessor section generates pulsing wave forms to drive an infrared source used in the differential source gas analysis technique.

16. A fire detector as recited in claim 2, wherein the smoke detector and the NDIR $CO_2$ sensor are combined in a single device but optically isolated from one another.

17. A fire detection system, comprising:

a detector assembly, comprising:

a case;

a housing contained within the case;

a substrate within the housing;

a thermopile detector fabricated on the substrate;

a silicon photodiode mounted on the substrate;

a light-tight barrier that separates and optically isolates the thermopile detector from the silicon photodiode and forms a carbon dioxide detector channel and a smoke detector channel within the case;

a light source mounted within the case;

a carbon dioxide filter located between the light source and the thermopile detector in the carbon dioxide detector channel;

a specularly reflective gas sample chamber formed between the light source and the thermopile detector in the carbon dioxide detector channel;

means for circulating gas into and out of the gas sample chamber; and a smoke detector scattering chamber formed between the light source and the silicon photodiode in the smoke detector channel;

an alarm; and a signal processor connected to the alarm and the detector assembly which contains logic means for generating an alarm signal when any of the following criteria are met:

light obscuration exceeds a threshold level for greater than a first preselected time;

light obscuration exceeds a reduced threshold level for greater than a second preselected time; or light obscuration exceeds the reduced threshold level and the rate of increase in the concentration of carbon dioxide ($CO_2$) exceeds a predetermined rate; and an alarm responsive to the alarm signal.

18. A smoke detector assembly as recited in claim 17, wherein the silicon photodiode is fabricated on the substrate.

19. A smoke detector assembly as recited in claim 17, wherein the signal processor is integrated into a single chip.

20. A smoke detector assembly as recited in claim 17, wherein the signal process generates pulsing wave forms to drive the light source.

* * * * *